US009038353B2

(12) United States Patent
Huncovsky

(10) Patent No.: US 9,038,353 B2
(45) Date of Patent: May 26, 2015

(54) SYSTEMS AND METHODS FOR REPAIRING UTILITY POLES

(71) Applicant: Jeffrey Huncovsky, Hermann, MO (US)

(72) Inventor: Jeffrey Huncovsky, Hermann, MO (US)

( * ) Notice: Subject to any disclaimer, the term of this patent is extended or adjusted under 35 U.S.C. 154(b) by 0 days.

(21) Appl. No.: 14/327,382

(22) Filed: Jul. 9, 2014

(65) Prior Publication Data

US 2015/0013267 A1 Jan. 15, 2015

Related U.S. Application Data

(60) Provisional application No. 61/844,233, filed on Jul. 9, 2013.

(51) Int. Cl.
*E04H 12/22* (2006.01)
*E04G 23/02* (2006.01)

(52) U.S. Cl.
CPC ..... *E04H 12/2292* (2013.01); *E04G 23/0218* (2013.01)

(58) Field of Classification Search
CPC ..... E02D 5/06; E02D 5/60; E02D 5/26; E02D 5/64; E02D 31/06; E02D 5/226; E04G 23/0203; E04G 23/02; E04G 23/0218; E04H 12/2292
USPC ..... 52/834–835, 843–845, 745.2, 745.02, 52/745.04, 745.17, 745.18, 745.19, 741.1, 52/741.3, 169.13, 169.14, 170, 514, 514.5, 52/515, 516; 405/211, 211.1, 216, 251, 405/252; 403/DIG. 15, 309–310, 312–313
See application file for complete search history.

(56) References Cited

U.S. PATENT DOCUMENTS

| | | | | | |
|---|---|---|---|---|---|
| 1,688,063 | A | * | 10/1928 | Trainor | 403/312 |
| 2,897,553 | A | | 8/1959 | Gorrow | |
| 2,943,876 | A | * | 7/1960 | Morris | 403/313 |
| 3,362,124 | A | * | 1/1968 | Val Cravens Du et al. | 52/514 |
| 3,679,250 | A | * | 7/1972 | Marsden | 403/313 |
| 3,724,151 | A | * | 4/1973 | Kaywood et al. | 52/295 |
| 3,846,030 | A | * | 11/1974 | Katt | 403/2 |
| 3,911,548 | A | | 10/1975 | Perry | |
| 4,280,567 | A | * | 7/1981 | Ijas | 173/129 |
| 4,309,263 | A | * | 1/1982 | Boyd | 204/196.17 |
| 4,439,070 | A | * | 3/1984 | Dimmick | 405/216 |
| 4,691,541 | A | | 9/1987 | McQuade, Sr. | |
| 4,702,057 | A | * | 10/1987 | Phillips | 52/514 |

(Continued)

FOREIGN PATENT DOCUMENTS

| | | | |
|---|---|---|---|
| CN | 101871273 | A | 10/2010 |
| CN | 103276937 | A | 9/2013 |

(Continued)

OTHER PUBLICATIONS

International Search Report, International Patent Application No. PCT/US2014/046031, issued on Oct. 29, 2014, 14 pages.

*Primary Examiner* — Beth Stephan
(74) *Attorney, Agent, or Firm* — Lewis Rice LLC

(57) ABSTRACT

A pole splint, generally for use with a broken wooden utility pole, which can provide for a strong repair at a pole breakpoint and which uses relatively little manpower and equipment to install, even under difficult conditions. The splint generally comprises two panels which are designed to be interconnected with elongated connectors. The connectors will generally interact with one of the panels through the use of a nut and washer, and may connect with the other panel through a nut and washer or via a chain formed of chain links.

6 Claims, 6 Drawing Sheets

(56) References Cited

U.S. PATENT DOCUMENTS

| | | | | |
|---|---|---|---|---|
| 4,916,874 | A * | 4/1990 | McCoy et al. | 52/293.2 |
| 4,934,675 | A * | 6/1990 | Klocke | 269/45 |
| 4,987,718 | A * | 1/1991 | Knight | 52/741.14 |
| 5,226,751 | A * | 7/1993 | Doleshal | 405/211.1 |
| 5,435,667 | A * | 7/1995 | Strange | 405/216 |
| 5,518,342 | A * | 5/1996 | Wright et al. | 405/211 |
| 5,573,354 | A * | 11/1996 | Koch | 405/216 |
| 5,816,746 | A * | 10/1998 | Blair | 405/216 |
| 5,862,883 | A * | 1/1999 | Carriere | 182/135 |
| 6,167,672 | B1 * | 1/2001 | Okitomo | 52/834 |
| 6,219,991 | B1 * | 4/2001 | Salek-Nejad | 52/741.3 |
| 6,773,206 | B2 * | 8/2004 | Bradley et al. | 405/215 |
| 6,896,447 | B1 * | 5/2005 | Taquino | 405/216 |
| 7,168,673 | B1 | 1/2007 | Piemonte et al. | |
| 8,465,063 | B1 | 6/2013 | Jones et al. | |
| 8,474,205 | B1 * | 7/2013 | Watkins | 52/292 |
| 2006/0024146 | A1 * | 2/2006 | Fink et al. | 411/103 |
| 2006/0027715 | A1 * | 2/2006 | Dinh et al. | 248/65 |
| 2007/0261349 | A1 | 11/2007 | Goldman et al. | |
| 2012/0131864 | A1 | 5/2012 | Blaylock | |

FOREIGN PATENT DOCUMENTS

| | | | |
|---|---|---|---|
| JP | H06323000 | A | 11/1994 |
| JP | H09287318 | A | 11/1997 |
| JP | 2003328500 | A | 11/2003 |
| JP | 2005282055 | A | 10/2005 |
| JP | 2011184985 | A | 9/2011 |

* cited by examiner

SYSTEMS AND METHODS FOR REPAIRING UTILITY POLES

CROSS REFERENCE TO RELATED APPLICATION(S)

This application claims benefit of U.S. Provisional Patent Application Ser. No. 61/844,233, filed Jul. 9, 2013, the entire disclosure of which is herein incorporated by reference.

BACKGROUND

1. Field of the Invention

This disclosure relates to systems and methods for repairing damaged or broken utility poles. More specifically, this disclosure relates to splints for reinforcing or temporarily repairing a damaged or broken pole and methods for using said splits.

2. Description of the Related Art

Power lines and various other public utilities, such as cable, fiber optic cable, and related equipment such as transformers, are traditionally supported aerially by long poles. Typically, these utility poles are made of wood and have a length of about 40 feet, which enables the lines and wires to remain overhead and significantly above the street and ground level to protect individuals in the area from contacting the lines in the normal course of operation. These utility poles withstand not only the weight of the cables, wires and attached transformers, but must also withstand the strong transverse gusts of wind. As a result, these long wooden poles are typically buried about six (6) feet underground and pressure-treated with a preservative for protection against rot, fungi and insects.

After some years in service, however, wooden utility poles tend to experience decay and rotting. A utility pole may also become damaged from other means, such as car accidents, strong wind, icing, animal activity, or lightning. This damage can result in weakening of the pole, ultimately resulting either in catastrophic damage (breakage) of the pole under conditions that the pole would normally resist, or in direct catastrophic damage to the pole.

When a pole suffers catastrophic damage and breaks, there is an immediate need to return the lines the pole carried back to the lines' original elevated position. In the first instance, particularly in the case of downed power lines, the lines themselves present a significant hazard to human and animal life. Further, downed lines mean that the resource carried by the lines is generally unavailable for a large number of users at the far end of the lines. This can result in further damage, loss of productivity, and even loss of life to the end users, depending on the extent to which the resource is unavailable and for how much time. For these reasons, utility companies generally need to get poles repaired and restanding and to have the lines fully functional as quickly as possible after the poles suffer catastrophic damage.

This is often easier said than done. Repairs often have to be made under poor working conditions (such as in heavy snow or ice or with strong winds) and may have to be made in locations that can severely disrupt traffic patterns and other infrastructure. Further, installing a brand new replacement pole can require acquisition of the replacement pole, getting it to the necessary location (which is also often further hampered by the situation that caused the damage), removal or bypassing of the damaged pole, digging a new hole and necessary support structures, getting the new pole installed, and reconnecting wires to the new pole. These activities can require significant time and manpower, which can result in significant time before the related service is restored to end users.

Because of these problems, utility companies will often not immediately replace a damaged pole, but will attempt to simply repair it as quickly as possible to get it standing in a temporary fashion. They can then replace the pole, or provide a more permanent repair, in a more leisurely time frame. This allows for the utility company to restore service quicker, even under difficult working conditions, while carrying out necessary replacements and more major repairs when they can do so with less disruption and cost.

Traditionally, the repairs to get poles standing again were haphazard and utilized with whatever materials were on hand. Often rope was used to tie (lash) the parts together or old cross pieces or even random pieces of broken wood were attached to provide for nailed splints. While this provided short term relief, the repairs lacked structural integrity and were subject to further damage relatively easily. This could be a problem if the conditions which caused the initial damage were likely to return. Further, as the repairs were generally fairly haphazard and could be different at each pole, the strength of any particular repair was subject to the skill of the workers installing it and the available tools and materials. Thus, in the event of fairly widespread damage, it was not clear which poles need to be replaced quicker to avoid additional damage and further outages when temporary corrections failed.

Accordingly, there is a need for a stronger and more efficient apparatus and system for reinforcing utility poles that provides for a more uniform repair.

SUMMARY

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Because of these and other problems in the art, described herein is a pole splint which can provide for a strong repair at a pole breakpoint and which uses relatively little manpower and equipment to install, even under difficult conditions.

There is described herein, among other things, a utility pole splint comprising: two panels, each of said panels comprising: an elongated center portion having two ends and a length therebetween, the center portion being generally semicircular in cross section between two edges; and two flanges, each connected with one of said two edges of said center portion and extending outward therefrom, each of said flanges including a plurality of holes; and a plurality of elongated connectors, each of said elongated connectors being capable of interacting with at least one of said plurality of holes; wherein said elongated connectors are used to interconnect holes from a first of said two panels with a second of said two panels.

In an embodiment of the splint, the elongated connectors include a threaded portion and interconnect with at least some of said plurality of holes via washers and nuts.

In an embodiment of the splint, at least some of said plurality of holes are keyhole-shaped.

In an embodiment of the splint, the keyhole-shaped holes are on a first of said flanges and non-keyhole-shaped holes are on a second of said flanges.

In an embodiment of the splint, the elongated connectors include a chain formed of chain links on one end and a threaded portion on an opposing end.

In an embodiment of the splint, the chain links connect with one of said keyhole-shaped holes and said threaded portion connects with one of said non-keyhole-shaped holes via a washer and nut.

In an embodiment of the splint, the central portion includes a hole therethrough which can be used as a handle.

In an embodiment of the splint, the central portion includes a handle attached thereto.

In an embodiment of the splint, the central portion includes at least one mounting hole for accepting a nail or screw therethrough.

In an embodiment of the splint, at least on of said flanges is further connected to the central portion by a plurality of gussets.

In an embodiment of the splint, the flanges are coplanar.

In an embodiment of the splint, the flanges are parallel.

There is also described herein, in an embodiment, a utility pole splint comprising: two panels, each of said panels comprising: an elongated central portion having two ends and a length therebetween, the central portion being generally semicircular in cross section between two edges; and two flanges, each of the flanges connected with one of said edges of said central portion and extending outward therefrom; a first of said flanges including a plurality of generally circular holes; and a second of said flanges including a plurality of keyhole-shaped holes; and a plurality of elongated connectors, each of said elongated connectors comprising a first end formed of a threaded shaft and a second end comprising a chain formed of chain links; wherein each of said elongated connectors are used to interconnect holes from a first of said two panels with a second of said two panels by placing said threaded shaft through said generally circular hole and attaching a nut and washer to said threaded shaft, and by placing said chain links through said keyhole-shaped holes such that one of said chain links is bound by a smaller portion of said keyhole-shaped hole.

There is also described herein, in an embodiment, a method for repairing a broken utility pole, the method comprising: providing two splint panels, each of said panels comprising: an elongated central portion having two ends and a length therebetween, the central portion being generally semicircular in cross section between two edges; and two flanges, each of the flanges connected with an edge of said central portion and extending outward therefrom, each of said flanges including a plurality of holes; and a plurality of elongated connectors, each of said elongated connectors being capable of interacting with at least one of said plurality of holes; placing a first of said splint panels on one side of said broken utility pole such that a break point of said utility pole is contacted by said central portion of said first splint panel between said two ends of said first splint panel; placing a second of said splint panels on an opposing side of said broken utility pole such that said break point of said utility pole is contacted by said central portion of said second splint panel between said two ends of said second half; and interconnecting said plurality of holes from said first splint panel with said plurality of holes of said second splint panel with said plurality of elongated connectors.

In an embodiment of the method, the elongated connectors include a threaded portion that interconnects with at least some of said plurality of holes via washers and nuts.

In an embodiment of the method, some of said plurality of holes are keyhole-shaped.

In an embodiment of the method, the keyhole-shaped holes are on a first of said flanges and non-keyhole-shaped holes are on a second of said flanges.

In an embodiment of the method, the elongated connectors include a chain formed of chain links on one end.

In an embodiment of the method, the chain links connect with said keyhole-shaped holes.

DESCRIPTION OF THE PREFERRED EMBODIMENT(S)

This disclosure is primarily focused on a splint for use in performing a repair, and generally an emergency repair, to a damaged wooden utility pole. In most cases, the pole will either have broken at some point along its length, or it will have cracked sufficiently that a future break at that point without intervention is sufficiently likely as to warrant corrective measures. However, one of ordinary skill would recognize that the splint described herein can be used on a utility pole which has not yet been damaged. For example, the splint described herein can be used as a preemptive measure. Further, the splint described herein can be used on non-wooden utility poles which have become broken or damaged and can also be used on other generally cylindrical wooden or non-wooden structures to provide for break correction or preemptive reinforcement even if such structures are not used as utility poles.

Figure 1:
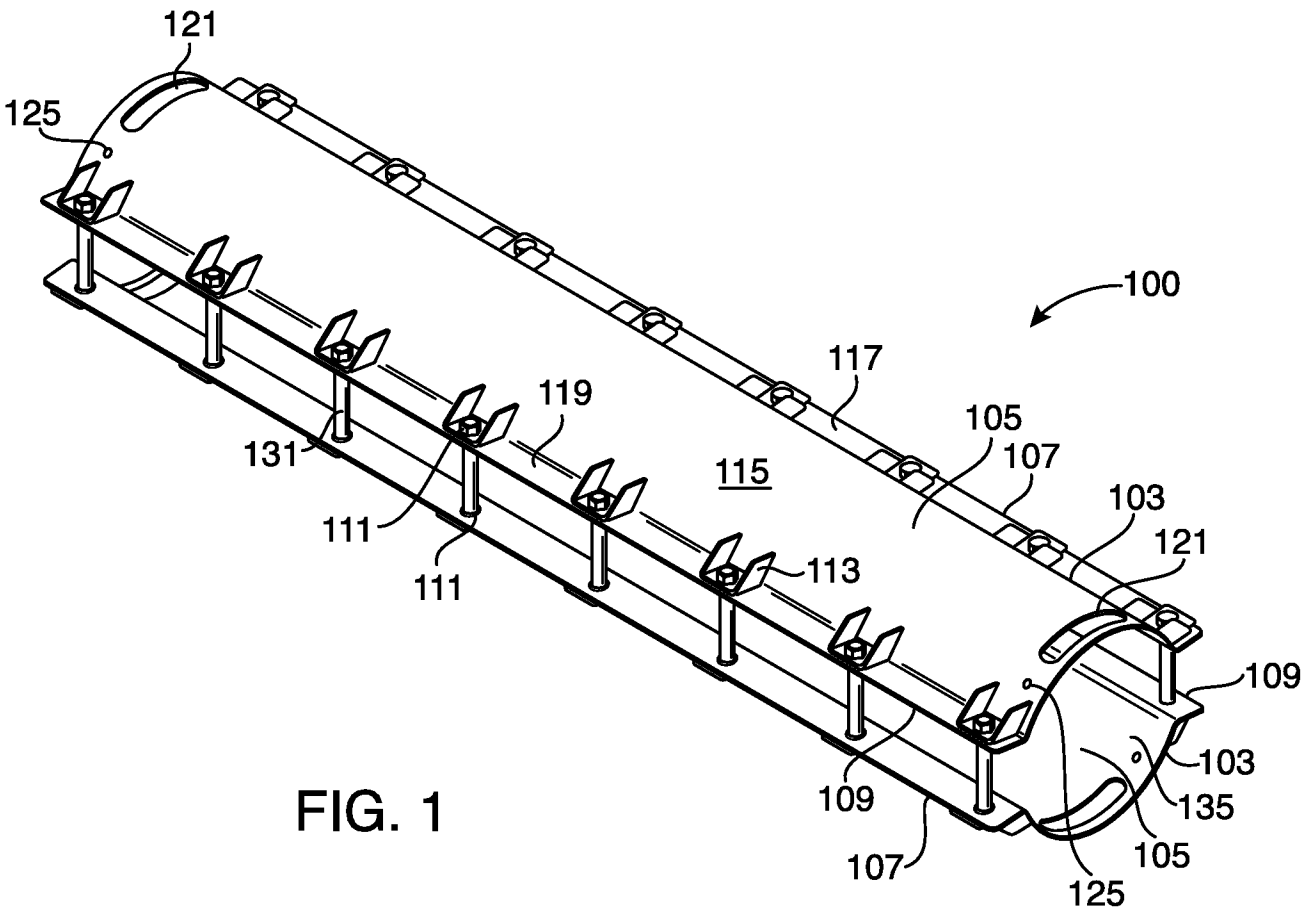
FIG. 1 provides a perspective view of a first embodiment of a splint.
Figure 2:
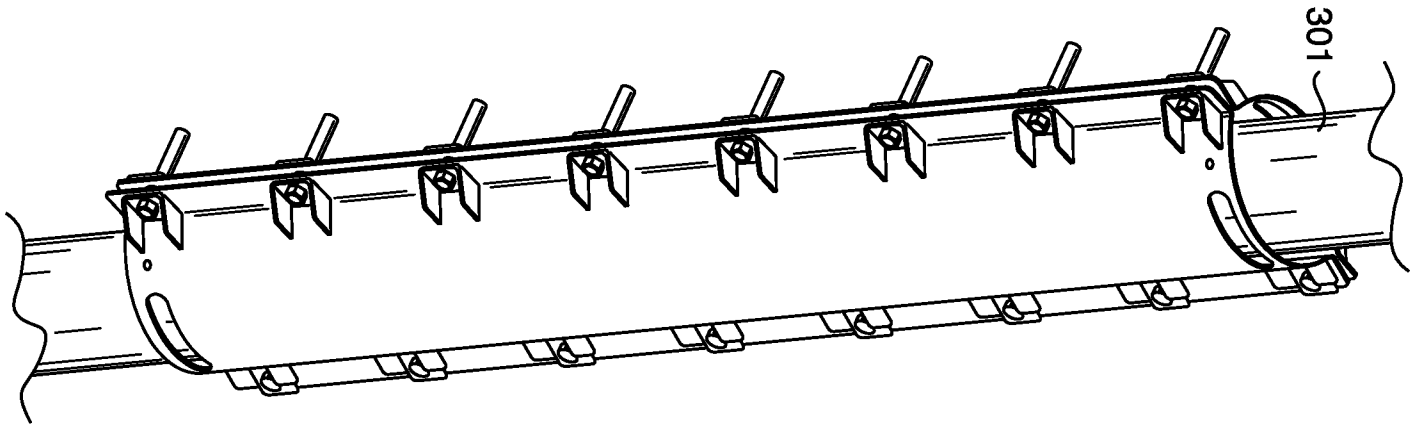
FIG. 2 provides a perspective of the embodiment of FIG. 1 in place on a broken utility pole.
Figure 3:
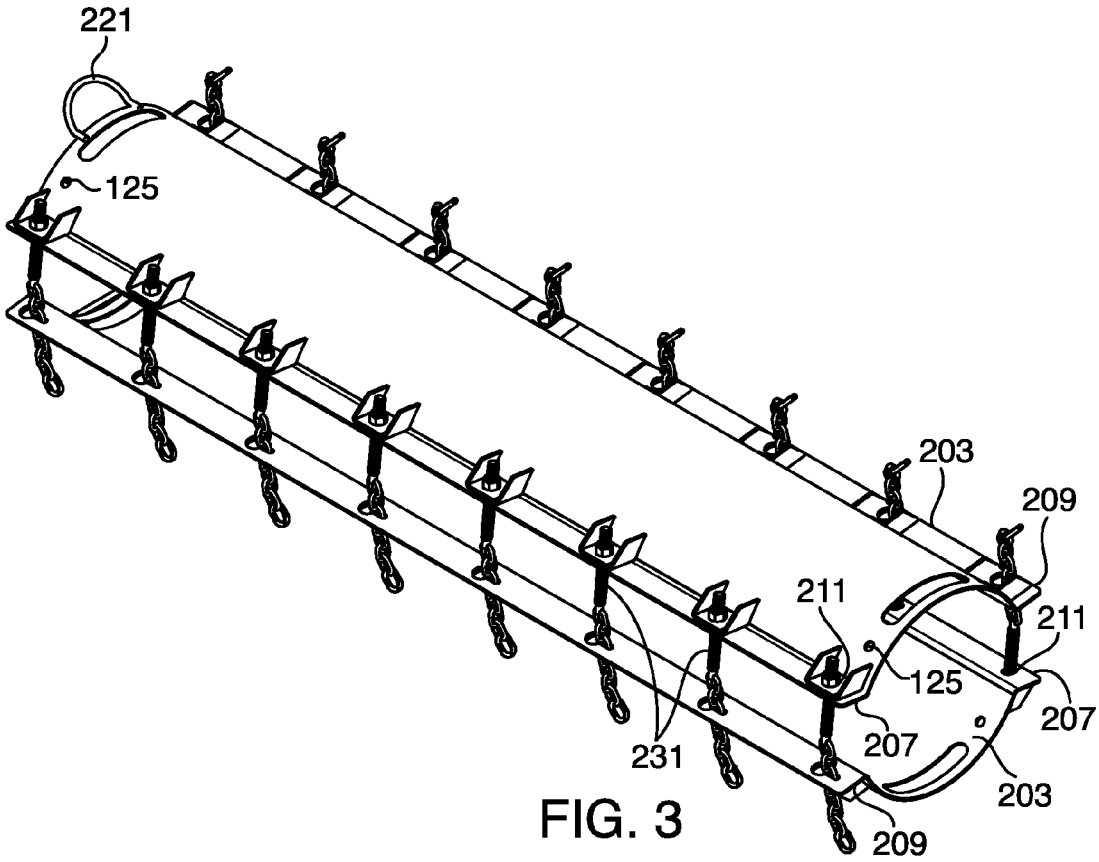
FIG. 3 provides a perspective view of another embodiment of a splint.
Figure 6:
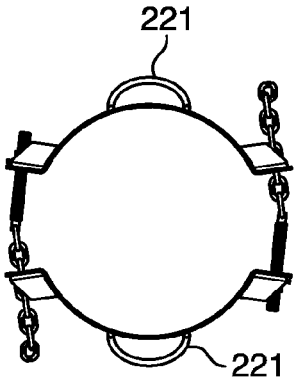
FIG. 6 provides an end view of the embodiment of FIG. 3.
Figure 4:
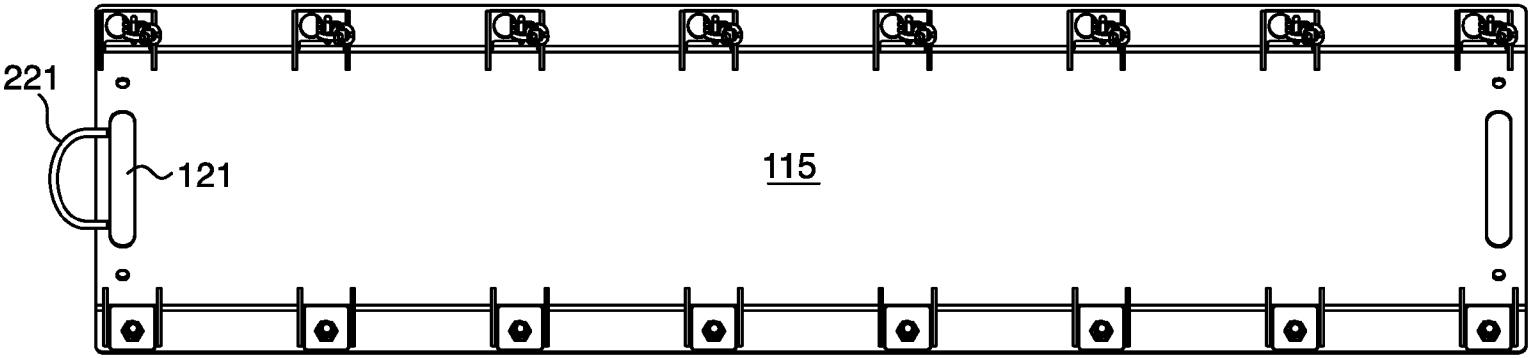
FIG. 4 provides a top view of the embodiment of FIG. 3.
Figure 5:
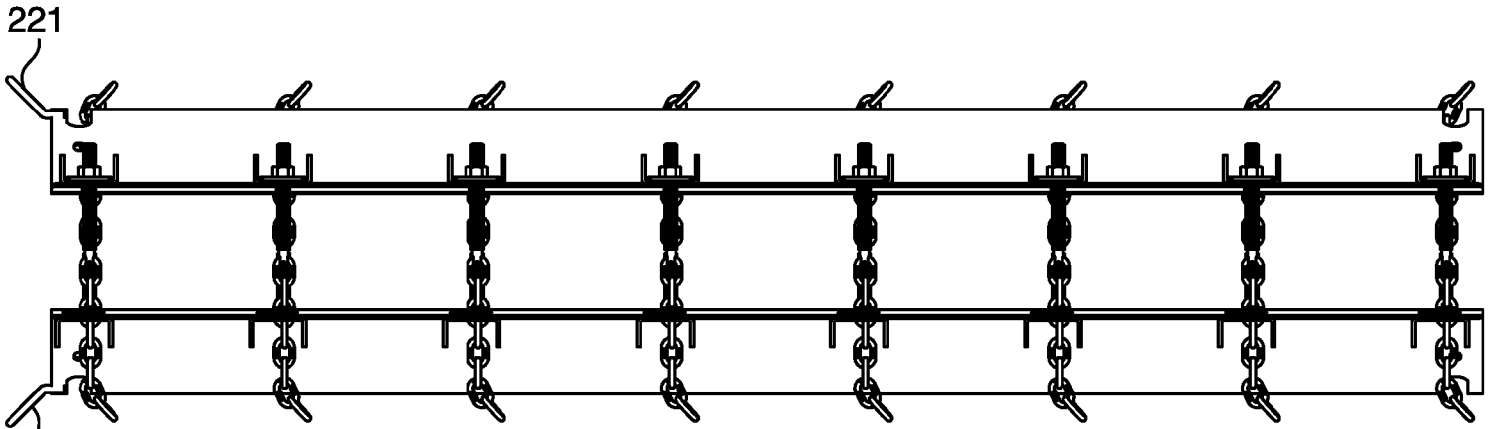
FIG. 5 provides a side view of the embodiment of FIG. 3.
Figure 7:
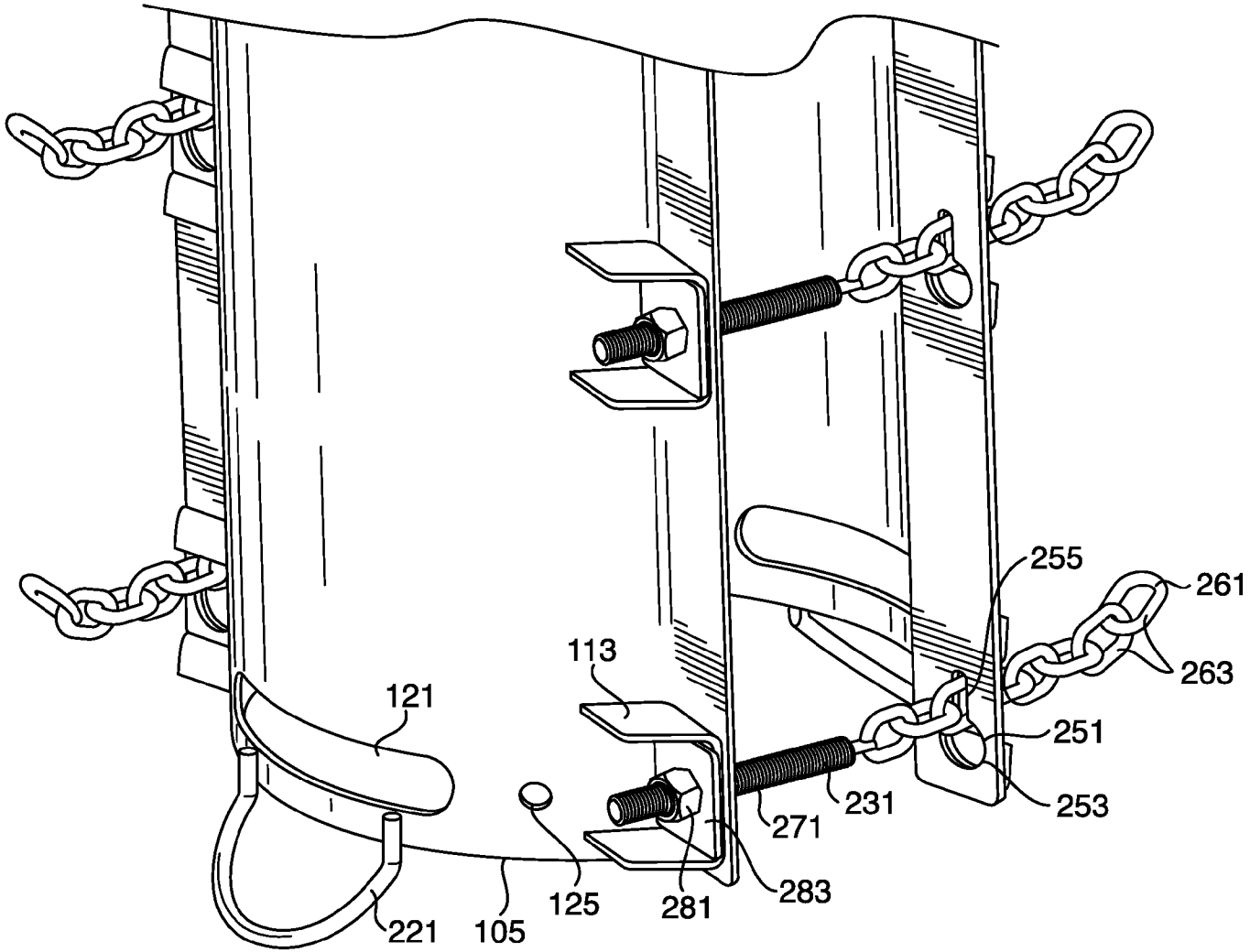
FIG. 7 provides a detail view of how to connect the opposing flanges of the embodiment of FIG. 3.

FIGS. 1-2 provide for a first embodiment of a pole splint device (100). The splint (100) generally comprises two identical panels (103) arranged opposing each other. Each panel (103) generally includes a center portion (105) that is semicircular in cross section and with longitudinal flanges (107) and (109) extending from each edge of the semicircular center portion (105). The flanges (107) and (109) are generally coplanar with each other, but that is not required. In alternative embodiments, the flanges (107) and (109) may be parallel but not coplanar or may be non-parallel. The flanges (107) and (109) will generally extend outwardly from the circumference of the center portion (105) so as to extend away from the volume enclosed in the semicircle. Each panel (103) is preferably formed from metal or another strong and fairly rigid material such as, but not limited to, injection plastic. It is generally preferred that the flanges (107) and (109) and center portion (105) of each panel (103) be formed as a single monolithic piece to provide for strength, but this is not required.

Each of the flanges (107) and (109) will generally include a plurality of holes (111) therethrough. The holes (111) will generally be evenly spaced along each flange (107) or (109) but that is by no means required. The flanges (107) and (109) may also include a plurality of reinforcing gussets (113) which are generally arranged roughly perpendicular to the plane of the associated flange (107) or (109) and serve to further connect an outer surface (117) and (119) of the associated flanges (107) and (109) to the exterior surface (115) of the center portion (105).

For ease of installation and transport, as well as to potentially reduce weight and material use, the center portion (105) may include one or more cutouts (121) at any point along its length. The cutout (121) will generally provide for the equivalent of a handle and can assist in grasping the panel (103) as necessary. In addition to or instead of the cutout (121), the panel (103) can also include an attached handle (221) as shown in the embodiment of FIGS. 3-6. The center portion (103) may also include one or more support holes (125). The support holes (125) are generally small holes designed to accept a screw or nail of standard design known to one of ordinary skill in the art. They may be used to additionally secure the splint (100) to the utility pole to inhibit it from moving during installation or from rotating or sliding relative to the pole during or after installation.

The two panels (103) will generally be connected together by a plurality of elongated connectors (131). The elongated connectors (131) may comprise a standard bolt or screw having a head that are designed to accept a nut on a single end thereof, or may comprise a single piece of threaded metal which can accept a nut onto both ends thereof. Both of these structures are well known to those of ordinary skill in the art. Regardless of which is used, the elongated connectors (131) will generally be positioned so as to pass through holes (111) on two adjacent panels (103). Washers and nuts will then generally be placed thereon so that the two panels (103) form a single connected splint (100). The two panels (103) with the elongated connectors (131) in place will generally be able to move toward and away from each other along the shafts of the elongated connectors (131), but will generally be inseparable from each other and constrained in proximity by the elongated connectors (131), nuts and washers.

FIG. 2 shows an example of the splint (100) of FIG. 1 as it would generally be positioned when in use on a utility pole (301). In order to utilize the splint (100), a user would generally begin with the two panels (103) and will have access to the broken utility pole (301). The user will generally first align the broken components of the utility pole (301) to the extent they are not already aligned. This may require the user to lift the top portion with a lifting device (generally a crane or similar piece of machinery) and position the top portion over the bottom portion. If the utility pole (301) is not badly damaged, the two pieces may simply be aligned or straightened relative to each other such as through the use of a prop.

Once the pole pieces have been aligned, the user will generally position a first panel (103) on one side of the broken portion with the other panel (103) opposing it. The two panels (103) will generally be pushed toward each other placing the inside surface (135) of each panel (103) against the exterior surface of the pole (301). It should be apparent that the semicircular shape of the center portion (105) can flex slightly if it is shaped too small or too large depending on the circumference of the pole (301). The two panels (103) will generally be positioned so that the holes (111) of each panel are generally aligned horizontally with those of the opposing panel. Depending on operation, once aligned the two panels (103) may be screwed or nailed to at least one of the portions of the pole through the support holes (125). This can serve to provide for initial support of the panels (103) to take weight off the user and hold the panels (103) in relative position. Alternatively, the step of using the support holes (125) need not be performed at this juncture and instead one may proceed as below attaching the elongated connectors (131).

With the panels (103) aligned, the user will generally run the elongated connectors (131) through the opposing holes (111) and will place a washer and nut on the threaded ends pursuant to the design of the elongated connectors (131). Depending on the location of the break in the utility pole (301), this step may require a second user in order to stabilize the panels (103). With the elongated connectors (131) positioned and nuts in place, the nuts will be tightened. This will generally be performed in a staggered pattern as would be understood by one of ordinary skill in the art so that all the nuts are tightened a generally similar amount and to prevent the halves form having undue stresses applied and for certain of the elongated connectors (131) being subject to undue stresses. The tightening will generally be by hand initially, and later through the use of a power nutdriver or drill which can be used to tighten them, possibly from opposing sides simultaneously.

The nuts will generally be tightened to a very high pressure forcing the two halves into the structure of the pole (301). Generally, the more pressure that can be applied, the stronger that the two portions of the pole (301) can be held together. In some cases, sufficient pressure may be applied to deform the flanges (107) and (109). However, this will generally be inhibited by the gussets (113). Once the two halves have been tightened to each other, to the extent not already done previously, the screws or nails are applied through the mounting holes (125) which serves to inhibit the splint (100) from rotating around the utility pole (301) or sliding longitudinally along the utility pole (301).

While FIG. 2 provides the expected arrangement of the components in most cases with the break located between the two panels (103), it should be recognized that alternative arrangements can also be used depending on the nature of the damage. For example, if a large amount of wood has been damaged above or below the point of break such that the pole (301) is splintered or significantly out of round in a large area, this area may be trimmed with a saw to provide for a cleaner break. Similarly, if the break is angled or other particularly different arrangement, the two panels (103) need not be perfectly aligned with each other. Instead, the two halves may be slightly misaligned so that, for example, the bottom holes of one half and the top holes of the second half are not aligned with a corresponding hole on the other half.

As should be apparent from FIG. 2, the splint (100) serves to form a compression splint on the pole (301) which serves to anchor the two broken pieces of pole (301) relative to each other and allow the pole (301) to be returned to standing. It is generally believed that with sufficient pressure applied to the nuts, the pole (301) portions can be connected and suspended with a gap between them. However, if the pole (301) is sufficiently heavy (for instance if the break is very low to the ground and the pole (301) carries a significant weight), it may be necessary to saw off the pole (301) portions at the point of break to provide a generally flat surface on each of the pole (301) pieces that can be placed adjacent and in contact to assist in weight bearing. It should also be apparent that, if a pole (301) is broken in multiple places, multiple splints (100) may be used as necessary.

FIGS. 3-7 provide for a second embodiment of a splint (200) which is of generally similar design to that of FIG. 1, but utilizes a slightly different structure for connecting the two panels (203) together. In this embodiment, the flanges (207) and (209) have different shaped holes to each other. The holes (211) on flange (207) are generally similar to those of the embodiment of FIG. 1 and are designed to accept a threaded elongated connector (231) as contemplated above in FIG. 1.

The holes (251), however, are keyhole-shaped having a larger upper portion (253) with a smaller lower portion (255).

In operation, instead of a pure nut and bolt connection, the elongated connector (231) will generally comprise a threaded portion (271) connected to a chain (261). The chain (261) generally comprises a number of interlinked rings (263). In standard fashion, the chain rings (263) are generally arranged in a fashion where the rings twist as each ring (263) is passed so that each ring (263) is generally arranged at a 90 degree angle to the ring (263) on either side of it.

Installation of the splint (200) is generally similar to that of the splint (100). However, when the panels (203) are placed adjacent to a pole (301), the elongated connectors (231) will already generally be attached to the flanges (207) by nuts (281). Because of the presence of the chain, and so long as the chain links (261) are larger than the holes (251), the elongated connectors (231) will generally not readily separate from the panels (203). When the panels (203) are placed adjacent, the chains (261) will generally be threaded through the large portions (253) of the holes (251). The chains (261) can then be manually pulled tight through portions (253) and then the appropriate link (263) can be slid into the smaller portion (255). Generally, this will require rotating the chain link (263) which is being positioned within the portion (255). The smaller portion (255) is generally sized so that the interaction point where there are two overlapping rings (263) is too large to slide through the smaller portion (255). The two panels (203) can initially be manually connected without the need to use tools or fiddle with small connectors such as nuts and washers. Once the chains (261) have all been cinched in and held as indicated above, the nuts (281) on the elongated connectors (231) can then be tightened to provide additional force. The chains (261) can also be wrapped around the panels (203) to provide for further support and may be locked or otherwise secured.

Figure 8:
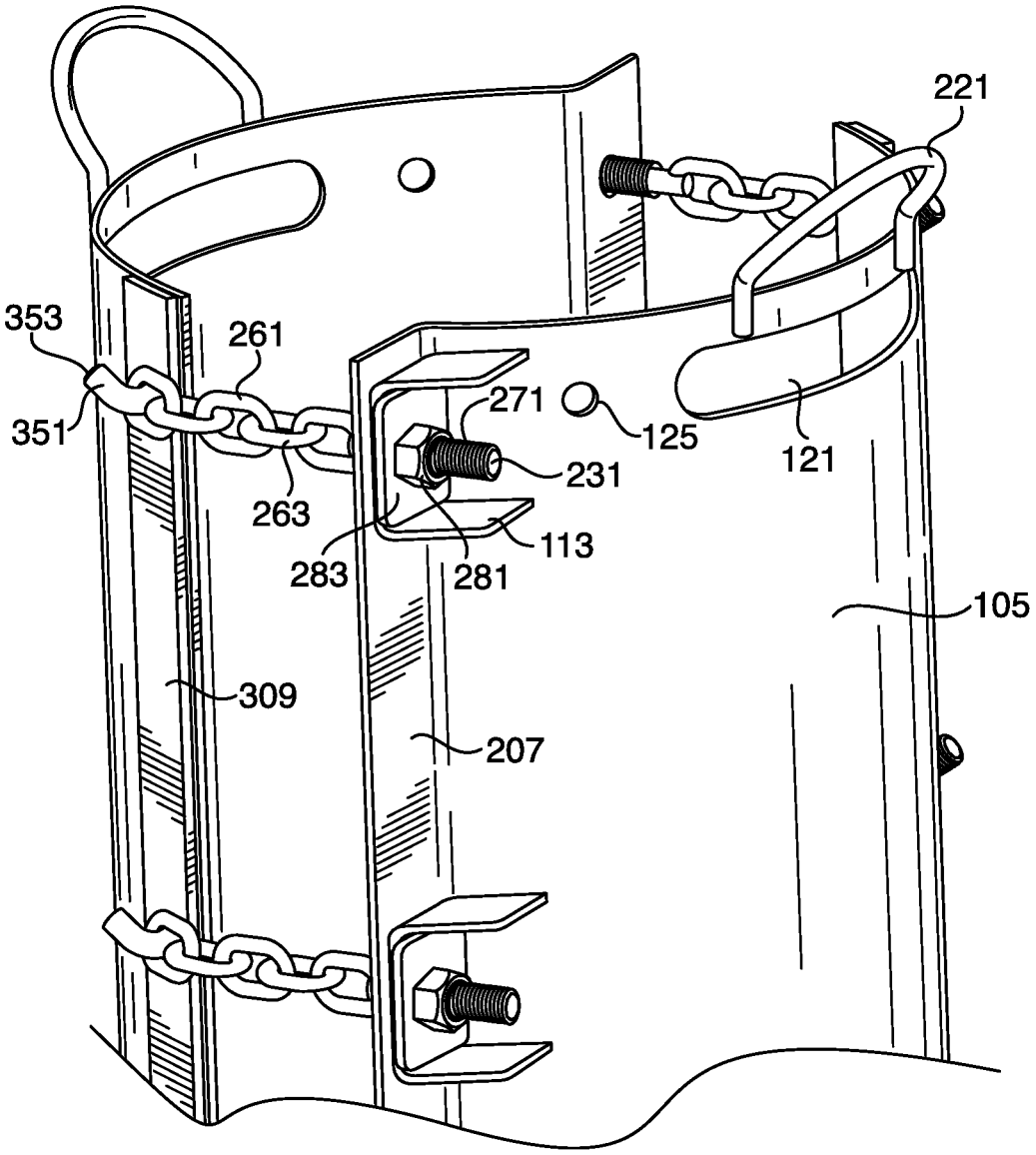
FIG. 8 provides a detail view of another embodiment of a splint.

FIG. 8 provides for a still further embodiment which is a variation of the embodiment of FIGS. 3-7. In FIG. 8, instead of a hole (251) on flange (209), there is provided a projection (351) which is connected directly to the center portion (105). The projection (351) will generally be non-linear and may comprises a curved or "J" shape. Alternatively, it may be linear and extend radially from the center portion (105) or at an angle to the center portion (105). Regardless of shape, the projection (351) will generally be configured to fit through a link (263) in the chain (261). It will generally also include an end (353) which is angled away from the flange (207) supporting the threaded portion (271). In operation, the projection (351) works according to the same principle as hole (251), however, instead of the chain being bound by the link (263) catching in the small portion (255), the link (263) is placed over the projection (351) (placing the projection (351) through the hole in the link (263)) and is bound in that fashion as shown in FIG. 8. For increased strength the projection (351) may be connected to a reinforcing platform (309) to the center portion (105).

As should be apparent, the embodiments of FIGS. 3-7 and 8 provide for a slightly more manual operation and utilize larger structures and movements for connection. This can simplify putting up the splint (200) as it is not necessary to operate on as many nuts (which generally require a tool and can be small, hard to handle, and easy to lose) compared to the chains (261), which are permanently attached and can be positioned by hand. This can allow for easier and quicker installation, and can also potentially allow the installation to be performed by a single user where, in other embodiments, two users may be required due to the need for sufficient hands to perform operations and support the panels (103) or (203). Further, while it is generally preferred that the elongated connector (231) include a nut (281) and washer (283) connection at the threaded end, this is not strictly necessary and a simple bolt head may be used on this end. However, this type of arrangement generally allows for there to be more play as the distance between the panels (103) is not as tightly limited.

Also shown in the embodiments of FIGS. 3-7 and 8 is an external handle (221). While the handle (121) is generally sufficient to use to carry the splint panels (103) or (203), it can be insufficient to assist in holding them in place on a utility pole during installation of nails or screws in mounting holes (125) or the elongated connectors (131) or (231) and/or chains (261). For this reason, the embodiments of FIGS. 3-7 and 8 provides for an external handle (221) which extends outward from the exterior surface (115) of the panels (103) or (203). This handle (221) can be particularly useful to hold the panel (103) or (203) against the surface of the pole (301) as its outward extension mean the handle can be grasped even when the panel (103) or (203) is in contact along the inside (135) of the center portion (105) with the pole (301). This can make it easier to hold one panel (103) or (203) while the other panel (103) or (203) is being positioned. The handle (221) can also be used to allow for the panel (103) or (203) to be suspended via a rope, chain, or similar object for the purpose of raising and holding the panel (103) or (203) in a position above the ground through the use of a crane or winch. Because the handle (221) extends outward from the exterior surface (115) of the panel (103) or (203), the panel (103) or (203) can remain suspended in this fashion during installation, if desired.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. A utility pole splint comprising:

two panels, each of said panels comprising:

an elongated central portion having two ends and a length therebetween, the central portion being semi-circular in cross section between two edges; and a flange, said flange connected with one of said edges of said central portion and extending outward therefrom, said flange including a plurality of holes;

a plurality of projections connected adjacent the other of said edges;

a plurality of elongated connectors, each of said elongated connectors comprising a first end comprising a threaded shaft and a second end comprising a chain formed of chain links;

wherein each of said elongated connectors are used to interconnect holes from a first of said two panels with projections of a second of said two panels by placing one of said threaded shafts through one of said holes and attaching a nut and washer to said threaded shaft, and by placing one of said chain links over one of said projections.

2. The splint of claim 1, wherein said central portion includes a hole therethrough which can be used as a handle.

3. The splint of claim 1, wherein said central portion includes a handle attached thereto.

4. The splint of claim 1, wherein said central portion includes at least one mounting hole for accepting a nail or screw therethrough.

5. The splint of claim 1, wherein said flange is further connected to said central portion by a plurality of gussets.

6. The splint of claim 1 wherein said plurality of projections are connected via a reinforcing platform to said central portion.

* * * * *